United States Patent [19]

Greer

[11] 4,350,969

[45] Sep. 21, 1982

[54] VEHICLE IDENTIFICATION AND POSITION SIGNALLING SYSTEM IN A PUBLIC TRANSPORTATION SYSTEM

[76] Inventor: William H. Greer, Daheim Rd., Millbrook, N.Y. 12545

[21] Appl. No.: 135,470

[22] Filed: Mar. 31, 1980

[51] Int. Cl.[3] ..... G08G 1/12; G08C 21/00

[52] U.S. Cl. ..... 340/23; 340/32; 364/460; 455/38; 455/49; 455/99

[58] Field of Search ..... 340/23, 24, 32; 364/424, 426, 444, 460; 455/38, 49, 99; 324/166, 160; 343/112 R, 112 D, 112 TC, 102; 235/92 TC

[56] References Cited

U.S. PATENT DOCUMENTS

| | | | |
|---|---|---|---|
| 3,644,883 | 2/1972 | Borman et al. | 340/23 |
| 3,886,515 | 5/1975 | Cottin et al. | 340/23 |
| 4,220,946 | 9/1980 | Henriot | 340/23 |
| 4,229,724 | 10/1980 | Marcus | 340/23 |

FOREIGN PATENT DOCUMENTS

| | | | |
|---|---|---|---|
| 2347724 | 4/1975 | Fed. Rep. of Germany | 340/23 |
| 2406266 | 5/1979 | France | 340/23 |
| 52-66175 | 6/1977 | Japan | 340/23 |
| 1384940 | 2/1975 | United Kingdom | 340/23 |

*Primary Examiner*—James J. Groody
*Attorney, Agent, or Firm*—Robert W. Berray

[57] ABSTRACT

Each vehicle of a transportation system is provided with a radio transmitter providing electable and different sequences of signals, one part of the signal identifying the vehicle, and another changing sequence of signals, either under operator control or automatically by attachment to the odometer, to indicate the present position of the vehicle on a scheduled route. The home of a passenger desirous of meeting a particular vehicle at a particular pickup point is provided with a radio receiver with selectable detectors which can be set to detect the signals from a particular vehicle transmitter, and provide a visual or audible indication of the present position of the vehicle on the scheduled route. Prespecified settings of the receiver, and corresponding detectable signals, inform a passenger of no service or delayed service.

7 Claims, 10 Drawing Figures

VEHICLE ENCODER CIRCUIT

VEHICLE IDENTIFICATION AND POSITION SIGNALLING SYSTEM IN A PUBLIC TRANSPORTATION SYSTEM

BACKGROUND OF THE INVENTION

This invention relates to a signalling system, and more particularly to the provision of a transmitter in each of the vehicles of a bus system, and a receiver in the home of a prospective passenger, for indicating to the passenger the present location of a particular bus normally scheduled to arrive at a particular pickup point at a certain time, providing the passenger with accurate information as to the time of arrival of a particular bus at the pickup point.

One of the first concerns of a prospective passenger of a public transportation system is whether or not a bus is in fact running, and its actual time of arrival at a particular pickup point along a regularly scheduled route. If a prospective passenger of a particular bus along a particular route can be provided with information as to the fact that the bus is running, and where it is presently located along its route, the passenger can leave his home at a more precise time to prevent the need for waiting in the open for a bus that may be late.

In a household with school children who ride a bus system from the public school, one of the first concerns is whether or not school is closed, delayed, or open, and that the assigned bus is running. Even though the bus is scheduled to arrive at the child's pickup point at a certain time, the next concern is whether the bus is early or late. The mother of a household with children scheduled to be picked up by a school bus would like to know exactly when the bus begins its run. Also, if the child must wait in the open, or walk some distance to a pickup point, she would like to know exactly where the bus is on its run so that the child can be sent from the house at the time required to catch the bus.

Applicant is unaware of any system associated with any form of public transportation, and more particularly, in a school bus system, that can provide information to a household concerning whether a particular bus is running, and its present position.

It is therefore a primary object of this invention to provide a radio signalling system in a public bus transportation system which can inform a prospective passenger that the bus system is running, and the present location of a particular bus in the system.

Another object of the present invention is to inform a prospective passenger of a public bus system of the fact that a particular bus is running.

A further object of the invention is to provide a prospective passenger of a public bus system of a visual or audible indication of the present position of a particular bus of interest to the prospective passenger.

SUMMARY OF THE INVENTION

To achieve the above cited objects, the present invention includes the provision of a standard form of radio transmitter and a standard form of radio receiver. Each of the transmitters will be installed in a bus of a bus system and provide a sequence of signals. An operator manipulates switches to provide bus identification. When the operator turns on the transmitter and/or ignition, the transmitter transmits signals indicating the bus is starting its run, and will generate signals identifying the bus. Either under operator manual control, or automatically, the transmitter will provide a sequence of signals which change in accordance with the position of the bus along a scheduled bus route.

A standard receiver in the home of each prospective passenger includes a number of signal detectors. Switch means provide selectability to set the receiver to respond only to the bus identification signals transmitted by a particular bus. The receiver is also equipped with means to indicate where the bus is located along its route at any particular time. In one form, visual indicators can be provided to indicate, in response to the position signals transmitted by the bus, the present position along the route. Also, the receiver can be provided with switch settable means to permit the prospective passenger to hear an audible sound when the position signals transmitted by the bus match a position selected by the passenger on the receiver. That is, if the prospective passenger is to be picked up at a pickup point number 20, and it takes a certain amount of time to reach the passengers pickup point from the house, the prospective passenger can be informed that the bus is presently at pickup point number 18.

An additional transmitter, under control of school officials, can be used to indicate whether or not school is closed, or delayed.

DETAILED DESCRIPTION OF INVENTION

Figure 1:
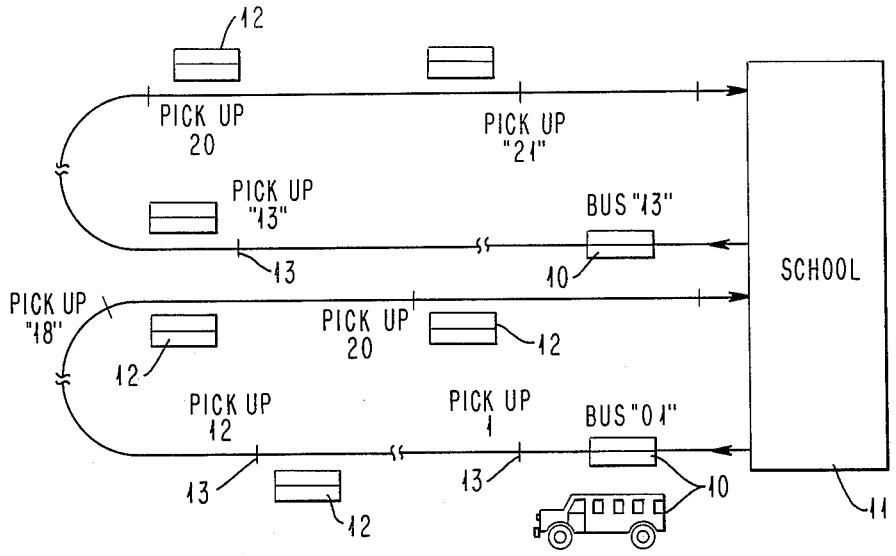
FIG. 1 is a schematic representation of a school bus system.

FIG. 1 is a representation of the transportation system, and more particularly a school bus system wherein a plurality of busses 10 will leave from a school 11 on a number of routes for the purpose of picking up children attending the school. Houses 12 along the route, have children who will be picked up at various pickup points 13. In the system of the present invention to be described, bus number "1" will proceed on a route with a number of pickup points. As an example, the children in a house who are to be picked up at pickup point 20 will be informed, for example, when bus number "1" has reached pickup point "18". In the same manner, houses along the route of bus number "13" will be informed of the progress of bus number "13". For example, the house at pickup point "21" can be informed when bus number "13" is presently located at pickup point "20", or any other pickup point depending on the amount of advanced warning required to get the children from the house to the pickup point. In accordance with the teaching of the invention, the indication to each of the houses in the bus system will not be confusing as between position signals from bus "1" and bus "13", even though the transmitters in busses are identical and receivers in homes are identical.

The transmitters mounted in each of the busses will be described in connection with FIGS. 2, 3, 4 and 5. Each of the transmitters in the busses will be a standard transmitter which will have operator adjustable switches for providing distinguishing characteristics for each of the busses in the system. The transmitter will be effective to transmit signals to receivers in each of the houses 12 which will first indicate that the busses of a particular school system are running, that a particular bus of interest has started its run, and the present location of the bus along the bus route.

Figure 2:
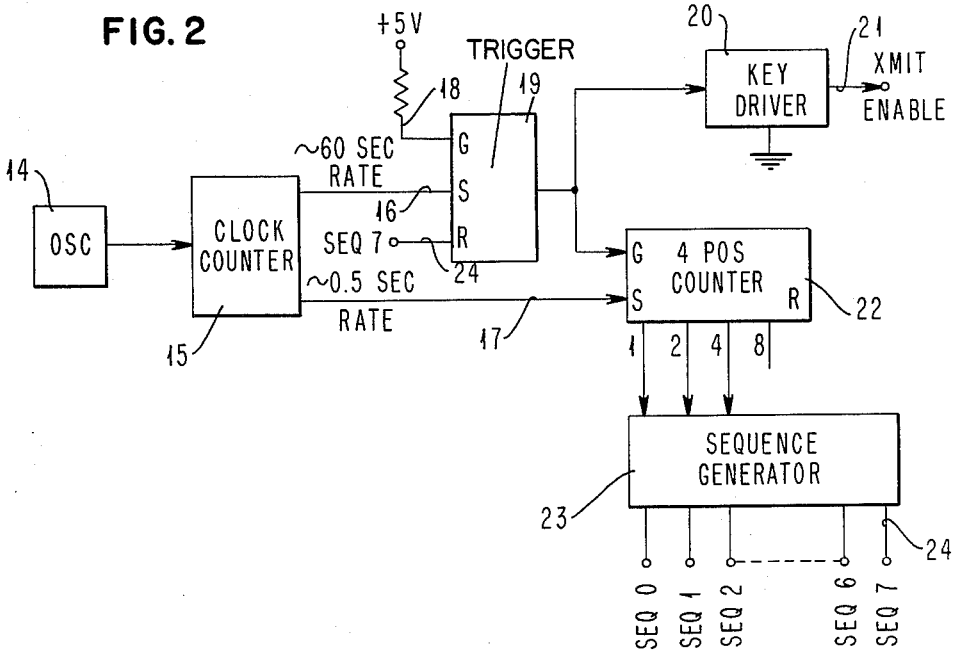
FIG. 2 is a block diagram of the apparatus for controlling the sequencing of a transmitter in a bus.

FIG. 2 shows the sequencer of the transmitter in each of the busses 10. The sequencer includes an oscillator 14 and clock counter 15 which are suitably combined to provide at least two outputs 16 and 17 which occur approximately every 60 seconds on output 16 and approximately every 0.5 seconds on output 17. When the operator turns on the ignition of a particular bus, or separately energizes the transmitter, the oscillator 14 will be started. Also, a power supply will provide a gate signal 18 to enable a trigger 19. Approximately once each minute, in response to an output on line 16, the trigger 19 will be set to enable a key driver 20, the output 21 of which enables the transmitter. Also, the setting of trigger 19 will render effective a four position counter 22 which will then be stepped at a rate determined by the output 17 of clock counter 15. The state of the four position counter 22 will be decoded in a sequence generator 23 to provide output pulses, in sequence, labeled SEQ0 through SEQ7. The output 24, labeled SEQ7, is applied to the reset input of trigger 19 to reset the system and start the sequencing from the beginning. The effect of the circuit in FIG. 2 then is to enable the transmitter by means of the output 21, and cause the sequence generator 23 to recycle from SEQ0 through SEQ7 once every minute.

Figure 3:
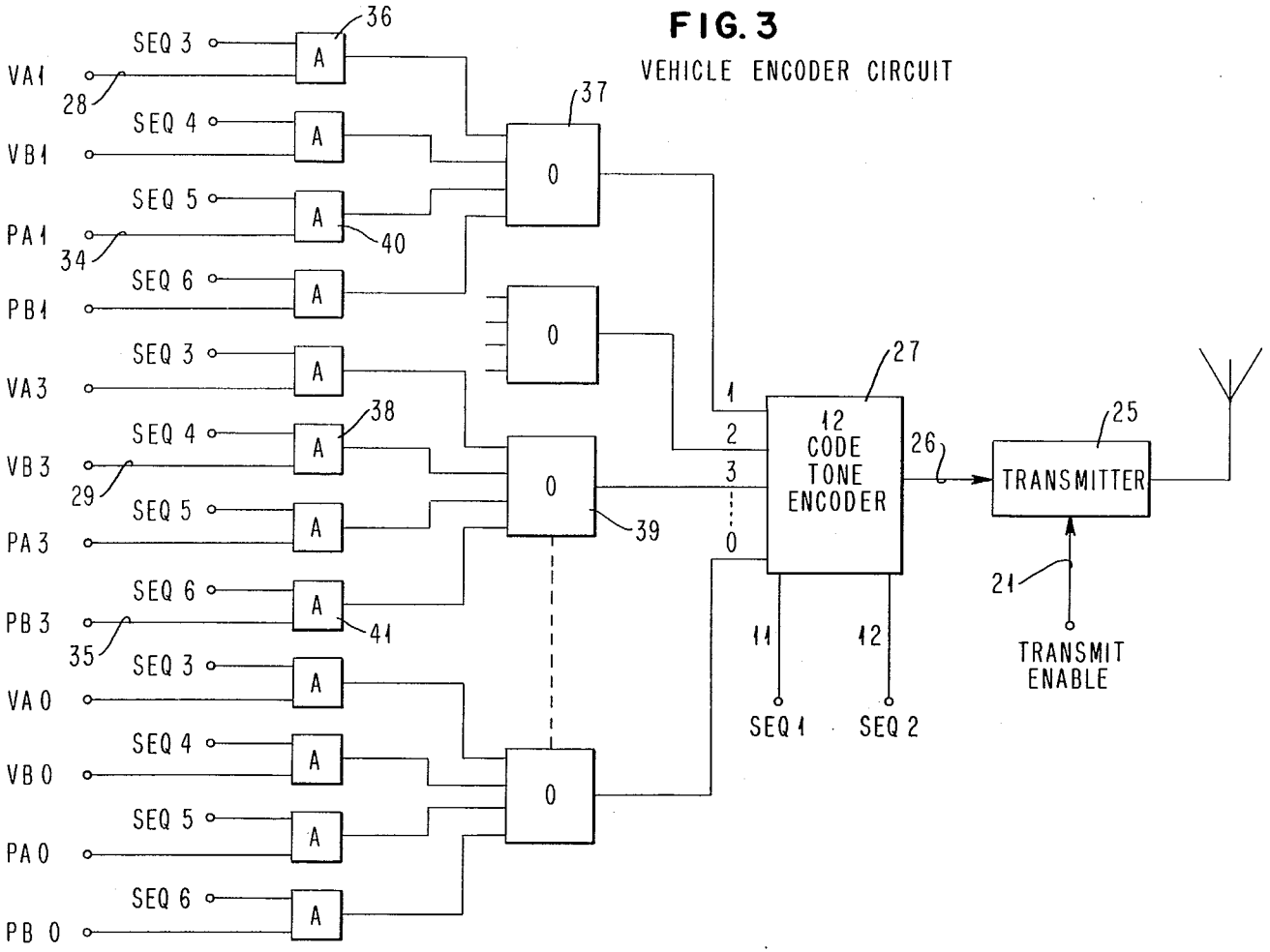
FIG. 3 is a schematic representation of a bus encoder circuit for converting vehicle and position identification switch settings to encoded tone signals for transmission.

In FIG. 3, a transmitter 25 will be enabled by the signal Transmit Enable 21 from FIG. 2. The output 26 of a twelve code tone encoder 27 produces a standard "touch tone" which produces different modulations to the transmitter 25 signifying the values 0 through 9, A and B. Each transmitter in each of the busses, will include a selector switch to enable the operator to set a bus identification in the switch. For example, a two digit selectability in each of the busses will provide for 100 different bus identifications. If fewer designations are required, one digit would be sufficient. In a like manner, if more than 100 designations are required, more switches can be provided.

As shown in FIG. 3 for example, bus number "13" shown in FIG. 1 would have a switch setting which enables a line 28 and a line 29. The lines in FIG. 3 are labeled, for example, VA1, VA3, etc., (A representing the first digit of the bus identification code). Lines labeled, for example, VB1, VB3, etc. represent the second digit (B) for the bus identification code. The enabling of lines 28 and 29 to indicate a vehicle identification code of "13" will be enabled from setting of switches 30 and 31 respectively in FIG. 4.

Figure 4:
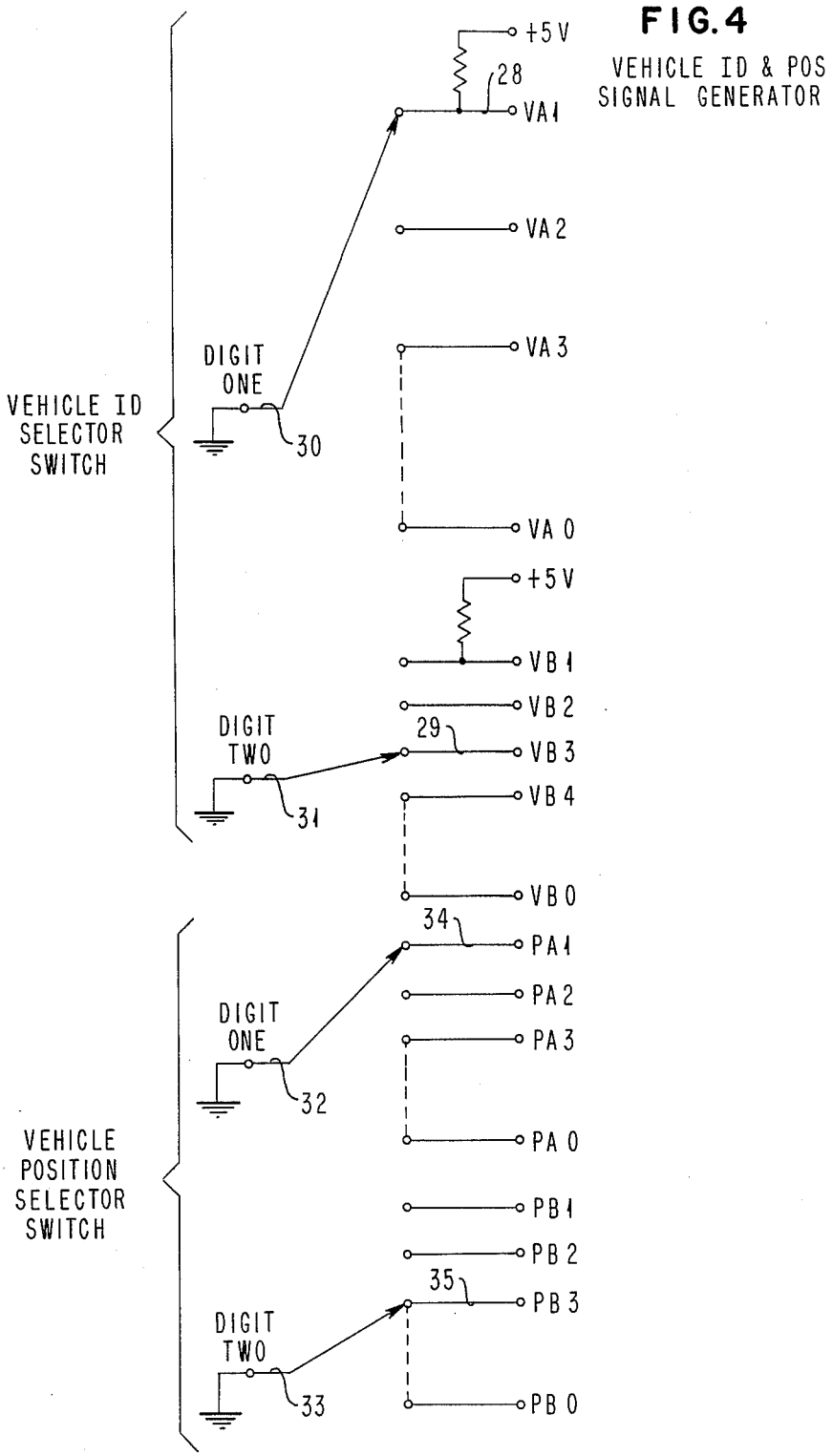
FIG. 4 is a schematic representation of selector switches for designating a particular bus identification number, and for indicating a bus position during a scheduled route.

Also shown in FIG. 4, are operator controlled switches 32 and 33 for providing the first and second digit, respectively, of a position code indicating the present position of the bus. For example, the settings shown indicates that the bus is presently at pickup point "13" energizing lines 34 (PA1) and 35 (PB3), and correspond to pickup point "13" shown in FIG. 1 for bus "13". The lines 34 and 35 from FIG. 4, indicating bus position, are also shown in FIG. 3.

The first output of the sequence generator 23 of FIG. 2, SEQ0, is unused and permits the transmitter 25 to be keyed on. As shown in FIG. 3, the outputs SEQ1 and SEQ2 will be effective in the 12 code tone encoder 27 to cause transmission of system identification signals corresponding to the digits 11 and 12. SEQ3 will be effective to transmit the next signal corresponding to the first digit of the vehicle code. SEQ4 will be effective to transmit the second digit of the vehicle identification code. SEQ5 will transmit the first digit of the position code and SEQ6 will be effective to transmit the second digit of the vehicle position code. The SEQ7 output, as shown in FIG. 2, is effective to reset the transmit cycle.

During SEQ3, an AND circuit 36 will be enabled, and through an OR circuit 37, will be effective to cause the tone encoder 27 to modulate the transmitter 25 to signify the digit 1. During SEQ4, AND circuit 38 will be enabled through OR circuit 39 to cause the tone encoder 27 to provide a modulated signal representing the digit 3. Therefore, the operator selected switch setting of 1, 3, will be effective during SEQ3 and SEQ4 to transmit the code 13 representing the bus number.

The present position of the bus as set by switches 32 and 33 in FIG. 4 will cause a two digit signal to be generated during SEQ5 and SEQ6. The setting shown in FIG. 4 corresponds to pickup point "13". During SEQ5, the AND circuit 40 will be enabled, and through OR circuit 37, will cause the tone encoder 27 to modulate the transmitter to once again transmit the signal representing the digit 1. During SEQ6, AND circuit 41 will be effective through OR circuit 39 to cause the tone encoder 27 to modulate the transmitter 25 to transmit the digit 3. At the completion of this sequence of transmission, the sequence of signals would include the digits 11, 12, 1, 3, 1, and 3 indicating that in this particular system, bus "13" is presently at pickup point "13". As the bus proceeds on its route, a changing sequence of position code signals will be transmitted as the operator changes the setting of switches 32 and 33 in FIG. 4.

Depending on the school system utilizing the present invention, the bus, for example number "13", may complete one run and embark on a second run. The number of the bus should be changed for the second run and this can be accomplished by the operator of the bus changing the bus identification on switches 30 and 31 of FIG. 4 to be used during the second run.

Figure 5:
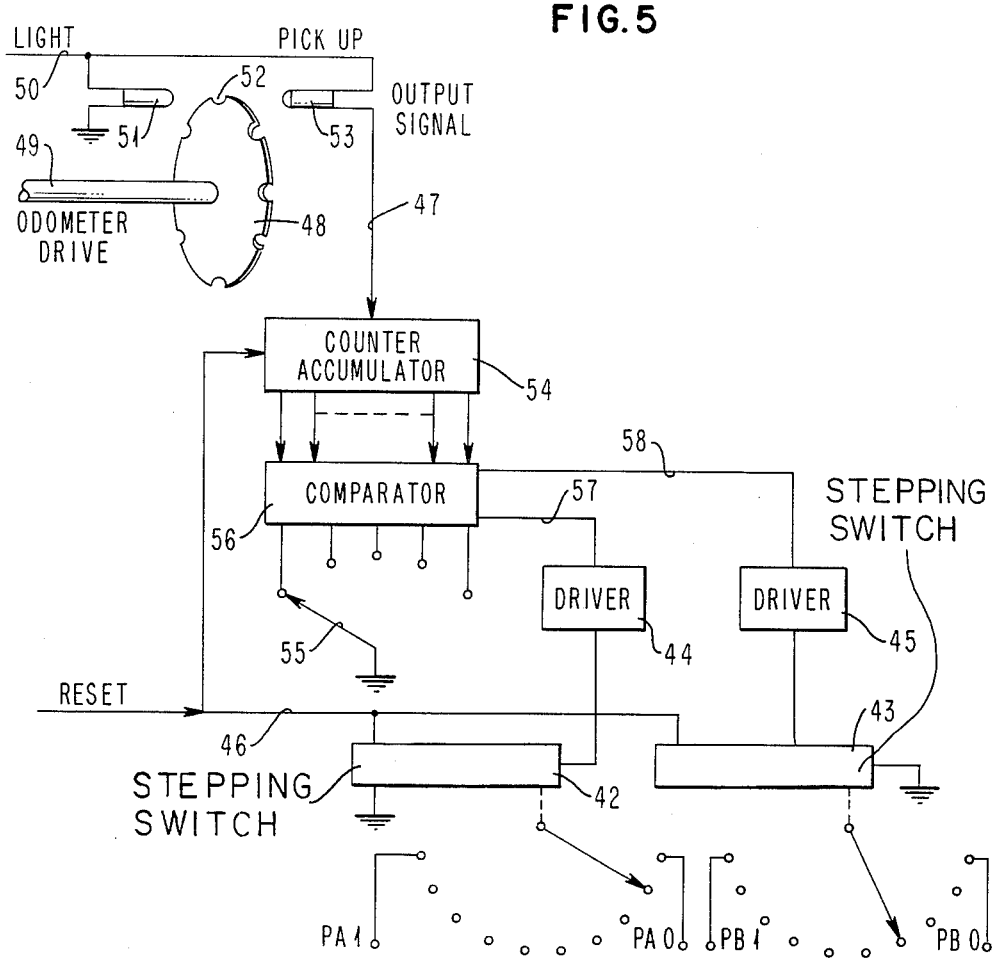
FIG. 5 is a schematic representation of a manner of generating a sequence of position indication codes automatically from a bus odometer cable.

In the description of FIGS. 3 and 4, the operator of the bus was required to change switch settings to provide an indication of the present bus position. FIG. 5 is a representation of a more automatic means of doing this which can be incorporated into the signalling system of the present invention. In the embodiment shown in FIG. 5, stepping switches 42 and 43 through the drivers 44 and 45 respectively, will cause the stepping of switches, automatically, to provide a sequence of position codes PA0–PA9 and PB0–PB9. In this embodiment, the position codes to be generated will be a function of the actual distance traveled by a particular bus. A reset signal on line 46 will be effective to reset the stepping switches 42 and 43 to zero. Stepping of the switches 42 and 43 will be under control of pulses generated on a line 47 which will be a function of the output of the bus odometer drive cable. A unit which can create the pulses 47 could be a "Speedometer Module Electronic Odometer" read-out unit such as manufactured by Federal Sign and Signal. This unit includes a slotted disk 48 which rotates at a speed dictated by the speed of the vehicle as reflected by the attachment to the odometer drive 49. When the ignition is turned on, and power supplied to a line 50, a light source 51 will be periodically interrupted by slots 52 in the disk 48 to cause pulses 47 to be generated from a photo cell pickup 53.

The output pulses 47 will be counted in a counter accumulator 54. In the arrangement shown in FIG. 5, it would be assumed that the sequence of vehicle position code signals would automatically increase one unit for some specified distance. For example, if the route is a 20 mile route, and there are one hundred possible positions, it would be desired to step the switches 42 and 43 one position every 0.2 miles. The particular rate at which it is desired to step switches 42 and 43 would be controlled by a settable switch 55 enabling a comparator 56 to cause outputs 57 and 58 at the desired rate to change the stepping switches 42 and 43 at the desired time. In this apparatus, the occupants of a house along the bus route would not be concerned with a particular pickup point at which the bus is located, but rather how far in distance the bus is along its route. Also, as evident in this embodiment, the operator of the bus would not be required to change the vehicle position code switches during the run.

Figure 6:
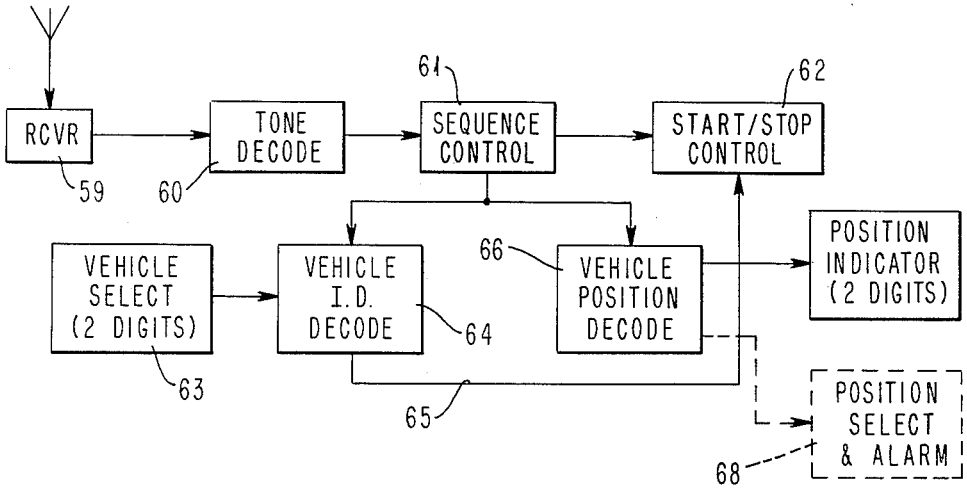
FIG. 6 is a block diagram of major components of a receiver in a home.

FIG. 6 is a block diagram of the major units of a receiver in each of the homes along the bus route. It includes a standard radio receiver 59 which receives the sequence of tone signals which are fed to a tone decoder 60 providing the outputs 0–9, A and B. A sequence control 61 and start/stop control 62 expects an input of three consecutive sets of tone pairs. The first set identifies the system which is preset into the entire transmission and reception system to initiate the decoding action. A second set indicates the selectable vehicle identification codes. A third set is decoded to indicate receipt of the vehicle position codes.

The occupants of a home will set switches to provide a two digit vehicle select 63, such as bus "13". The vehicle identification signals generated by tone decoders 60 will be presented to a vehicle identification decoder 64 to be compared with those selected at 63. If these do not match, an output on 65 will be effective at the start/stop control 62 to reset the system. If the vehicle identification signals do correspond to those selected at 63, the sequencer 61 continues, and provides an indication of the vehicle position in a vehicle position decoder 66, the output of which can be utilized to energize a visual position indicator 67 comprised of a suitable display unit. Alternatively, additional selectable switches can be provided on the receiver when it is desired to select an indication as to when the bus of interest has arrived at a particular pickup point. Position select and alarm means 68 would include selectable switch means for setting a particular pickup position code which, when the vehicle position decode 66 indicates a correspondence, would activate an audible alarm to provide a warning that the bus has reached the pickup point of interest.

Figure 7:
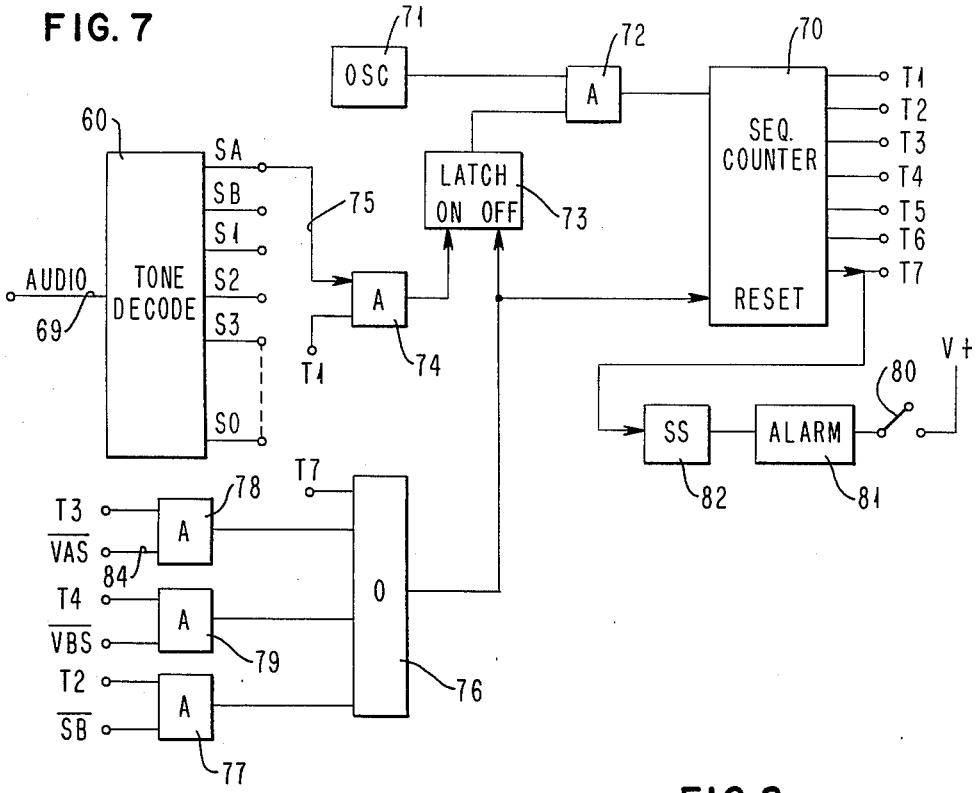
FIG. 7 is a schematic representation of a receiver sequence control.

Additional details of the sequence control 61 and start/stop control 62 of FIG. 6 is shown in FIG. 7. The tone decoder 60 provides output signal lines corresponding to the detected tone signal on line 69 received from the receiver. A sequence counter 70 has a reset state labeled T1. When the receiver is turned on, an oscillator 71 will be enabled. The oscillator 71 will not have any effect on the sequence counter 70 until an AND circuit 72 is enabled by a latch 73. Latch 73 will be turned on by the output of an AND circuit 74 which stands enabled by the sequence counter setting of T1. AND circuit 74 will provide an output to turn on latch 73 when the first digit of the system code is detected on line 75. When latch 73 is turned on, AND circuit 72 is rendered effective to transfer oscillator 71 pulses to the sequence counter 70 to step the sequence counter through positions T1, T2, etc.

Once the sequence counter 70 has been enabled by the latch 73, it can be reset in response to a number of conditions as reflected by the output of an OR circuit 76. At sequence time T2, AND circuit 77 will provide an output and reset the system if the second digit of the system code is not received. AND circuit 78 will provide an output through OR circuit 76 to reset latch 73 at sequence time T3 if the first digit of the vehicle identification code is not as selected. AND circuit 79 will provide an output at sequence time T4 if the second digit of the vehicle code selected is not proper. Finally, at sequence time T7, the system will be caused to reset awaiting the next transmission of the sequence of signals. As previously mentioned, the complete sequence of signals occurs approximately every one minute. If the sequence counter 70 proceeds through sequence output T4, it is known that the signals being received are from a particular bus which has been selected by vehicle select 63 of FIG. 6.

Also shown in FIG. 7, is the ability to close a switch 80, and thereby be informed by an audible alarm 81 when the bus of interest has in fact started its run. The alarm 81 will be energized by a single shot 82, the first, and any subsequent times, the sequence counter 70 has proceeded through its sequence to sequence time T7. As indicated previously, the sequence time T7 will only be generated when the sequence counter 70 proceeds through its entire sequence when the bus of interest, selected by the switches, has generated its identification signal, and the signal is received by the receiver. The alarm 81 thus provides the indication that the bus of interest has in fact left. Switch 80 can be opened to eliminate the alarm each time the signal is detected.

Figure 8:
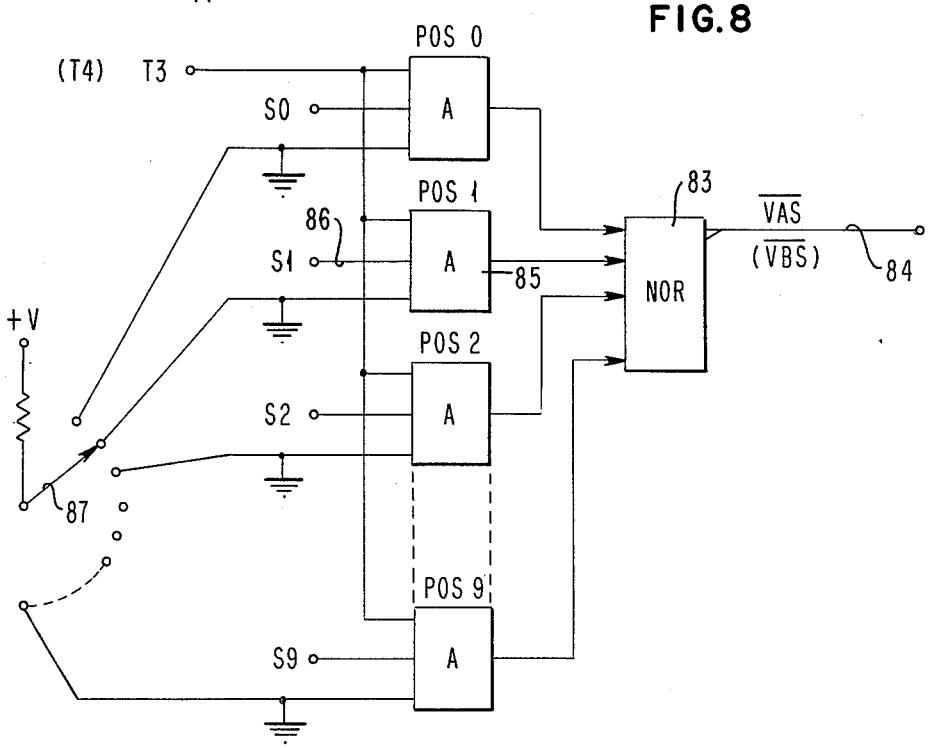
FIG. 8 is a schematic representation of the switches for selection of detectable signals associated with a particular vehicle identification signal.

FIG. 8 shows signal detector selection for the first digit of a vehicle identification code. The signal output 84 corresponds to the signal 84 shown at AND circuit 78 of FIG. 7. The logic of FIG. 8 is effective during sequence counter time T3 for detecting the first digit of the vehicle identification code. For example, NOR circuit 83 will produce output 84 at time T3 unless, as shown in FIG. 8, AND circuit 85 produces an output. AND circuit 85 will produce an output when the tone decoder 60 of FIG. 7 produces an output indicating the number 1 (51) on line 86, and switch 87 is set to position 1. In all other cases, at time T3, if some other digit than that selected by switch 87 is decoded, NOR circuit 83 will provide the output 84 to cause a resetting of the sequence counter 70 through AND circuit 78 in FIG. 7.

FIG. 8 is also representative of the logic required for indicating the proper reception of the second digit of a vehicle identification code at sequence counter time T4. This output would be effective at AND circuit 79 in FIG. 7 to either reset the sequence counter 70 or allow it to proceed.

Figure 9:
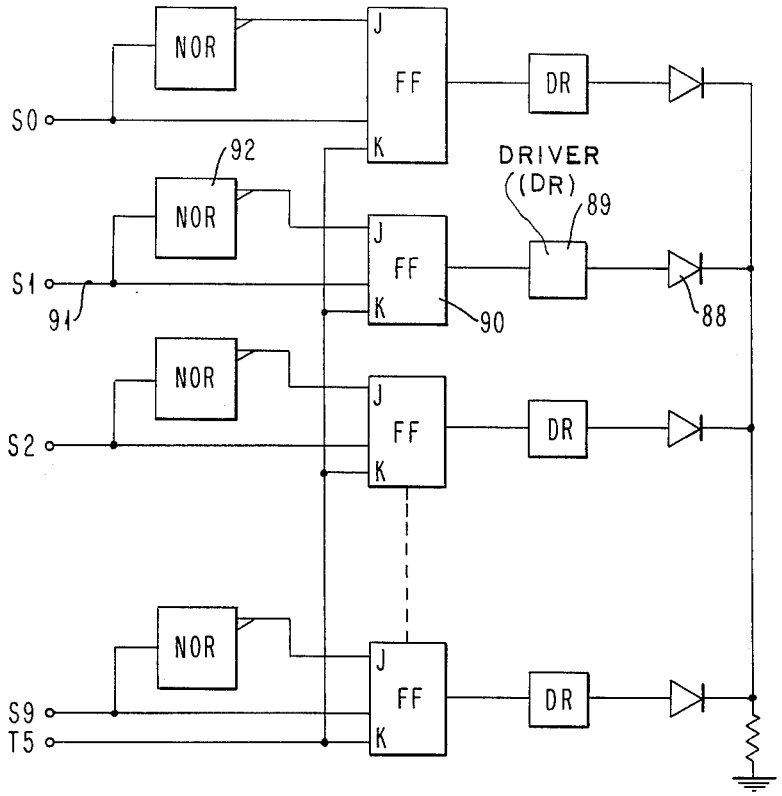
FIG. 9 is a schematic representation of a technique for visually indicating the first digit of a received position signal showing the present location of the bus of interest.
Figure 10:
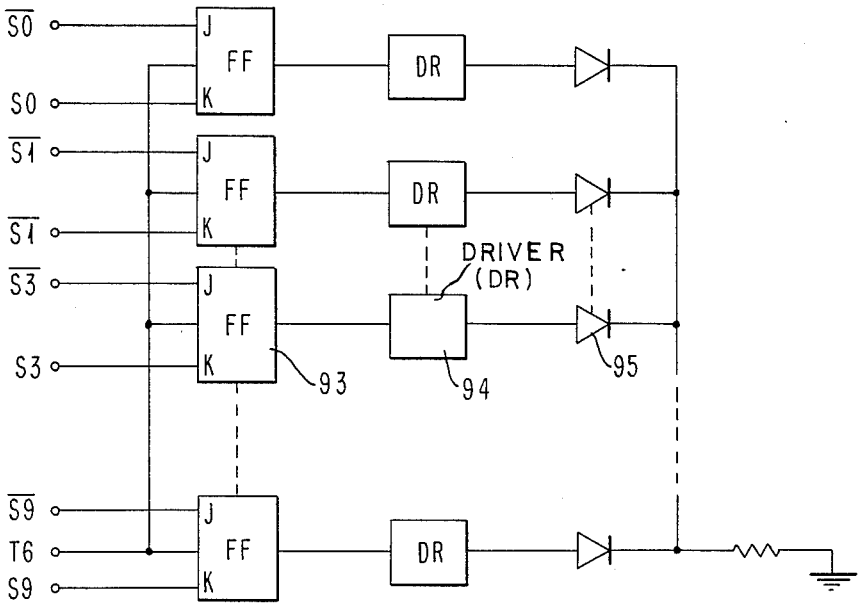
FIG. 10 is a schematic representation for visually indicating the second digit of a position signal transmitted from a bus.

FIG. 9 and FIG. 10 show the logic for energizing indicator lights when the receiving mechanism has proceeded to sequence steps T5 and T6 for recognition of the two-digit vehicle position code transmitted. If for example, the bus of interest is at the pickup point "13", being the one of interest, an indicator light 88 will be illuminated representing the digit 1 through a driver 89 enabled by the turning on of a flip flop 90. Flip flop 90, as well as all other flip flops will be gated to be turned on at sequence time T5. If the first digit of the vehicle position code has been decoded as being the digit 1 as represented on line 91, flip flop 90 will be set energizing driver 89 and indicator light 88. When the first digit signal on 91 disappears, indicated by a NOR circuit 92, flip flop 90 will be turned off. It will be recalled that a changing sequence of position codes are transmitted as the bus proceeds along its route.

FIG. 10 shows the same general arrangement for providing indication of the second digit of the vehicle position code. For example, if the vehicle is at pick-up point 13, the position code signal being received at sequence time T6 will be effective to set flip flop 93 to energize driver 94 and turn on the indicator 95 corresponding to the digit 3.

In connection with providing an indication of the vehicle position, the vehicle position decode mechanism 66 of FIG. 6 will continuously store the position code received from the vehicle of interest when its position code signals are in fact received. Therefore, the inputs to the flip flops 90 and 93 in FIGS. 9 and 10 will be maintained until the vehicle position decode 66 of FIG. 6 receives a different code from the vehicle of interest. Further, if it is desired to utilize the vehicle position decode 66 to energize an alarm in the position select and alarm 68 shown in FIG. 6, logic like that shown in FIG. 8 can be utilized. That is, first and second digits of a position code can be selected by first and second switches to cause the AND circuits of FIG. 8 to provide an output when the selected signal matches that generated by the bus to cause the AND circuit to set a trigger. When the triggers associated with both digits of the selected position code are set, an AND circuit can be energized to provide an output to any suitable audible alarm.

The system disclosed can easily be adapted to inform households that school is closed on "snow days", or delayed. An additional transmitter will be available to a school official. Previously provided instructions will inform each household that bus identification codes "00" and "01" will have special meaning.

When a decision has been made that school is to be closed because of snow, a school official will cause the school transmitter to transmit the codes "0000". Each household will set the receiver switches to these settings and be immediately informed of the closing. If no response is received on these settings, school will be open, but possibly delayed. The setting "0102", for example, transmitted by the school, and detected by the receivers, will mean that school is delayed for two (2) hours.

There has thus been shown a transportation system which permits prospective passengers along a scheduled bus route to be informed of important information, allowing the prospective passenger to arrive at a pickup point essentially at the same time that the bus arrives. This is accomplished by first informing the prospective passenger that a particular bus of interest has started a bus run, keeps the prospective passenger informed of the progress along the run, and permits selection by the prospective passenger of notification of when the bus has reached a particular point, previously selected by the prospective passenger, to provide sufficient time to reach the pickup point when the bus arrives.

While the invention has been particularly shown and described with references to preferred embodiments thereof, it will be understood by those skilled in the art that the foregoing and other changes in form and details may be made therein without departing from the spirit and scope of the invention.

Having thus described my invention, what I claim as new, and desire to secure by Letters Patent is:

1. A system for notifying prospective passengers of a transportation system of the approach of a particular vehicle, at a predetermined pickup point, comprising:

transmitter means mounted in each of the vehicles for transmitting selectably different detectable signals, including operator control switch means, selectively actuated by an operator to cause transmission of said detectable signals, one of said detectable signals including a particular vehicle identification code, and another of said detectable signals including a changing sequence of vehicle position codes;

receiver means, remote from any pickup point and in the possession of a prospective passenger, having a plurality of signal detectors including switch means, manipulated by a passenger, to select a signal detector responsive to a selected one of said detectable signals providing a particular vehicle identification code and a particular vehicle position code; and indicator means associated with said receiver means, and connected to said signal detectors, for providing a position indication in response to correspondence between said selected signal detector and the particular ones of said detectable signals from said transmitter means.

2. A system in accordance with claim 1 wherein:

said means for providing a position indication is a visable display device for displaying a position indication for each of said changing sequence of vehicle position codes.

3. A system in accordance with claim 1 wherein:

said means for providing a position indication is an audible alarm, connected to said signal detectors, for providing an audible signal when said particular one of said changing sequence of vehicle position codes is received.

4. A system in accordance with claim 1 wherein said switch means which causes transmission of said changing sequence of vehicle position codes includes:

stepping switch means, connected to said means for transmitting selectably different detectable signals, to provide said changing sequence of vehicle position codes;

pulse generator means connected to the odometer cable of the vehicle for providing stepping pulses; and means, connecting said stepping pulses to said stepping switch means, to thereby change said stepping switch means, and provide said changing sequence of vehicle position codes.

5. A receiver for use in a system for notifying prospective passengers of a transportation system of the approach of a particular vehicle, at a predetermined pickup point, wherein each vehicle includes transmitter means for transmitting different detectable signals, to cause transmission of a series of detectable signals providing vehicle identification codes and vehicle position codes, the receiver including:

a plurality of signal detectors including switch means, manipulated by a passenger, to select a signal detector responsive to a particular one of the vehicle identification codes and vehicle position codes; and indicator means, including an audible alarm, connected to said signal detectors, for indicating correspondence between said selected signal detector and said particular detectable signals from said transmitters.

6. A receiver in accordance with claim 5 wherein said indicator means includes:

a visable display device for displaying a position indication for each of a changing sequence of vehicle position codes.

7. A receiver in accordance with claim 6 wherein:

one of the detectable vehicle identification code and position code signals is a code indicating the transportation system will be delayed for a specified time.

* * * * *